US006168503B1

(12) United States Patent
Pao et al.

(10) Patent No.: US 6,168,503 B1
(45) Date of Patent: Jan. 2, 2001

(54) METHOD AND APPARATUS FOR PRODUCING A HIGH-VELOCITY PARTICLE STREAM

(75) Inventors: Y. H. Michael Pao, Houston, TX (US); Peter L. Madonna, Auburn, WA (US); Ross T. Coogan, Houston, TX (US)

(73) Assignee: Waterjet Technology, Inc., Kent, WA (US)

( * ) Notice: Under 35 U.S.C. 154(b), the term of this patent shall be extended for 0 days.

(21) Appl. No.: 09/113,975

(22) Filed: Jul. 9, 1998

Related U.S. Application Data

(63) Continuation-in-part of application No. 08/891,667, filed on Jul. 11, 1997, now abandoned.

(51) Int. Cl.[7] ..... B24B 1/00

(52) U.S. Cl. ..... 451/40; 451/38; 451/9; 451/102

(58) Field of Search ..... 451/38, 40, 9, 451/102

(56) References Cited

U.S. PATENT DOCUMENTS

| | | | | |
|---|---|---|---|---|
| 3,424,386 | | 1/1969 | Maasberg et al. . | |
| 4,080,762 | | 3/1978 | Watson . | |
| 4,125,969 | | 11/1978 | Easton . | |
| 4,389,820 | | 6/1983 | Fong et al. . | |
| 4,540,121 | | 9/1985 | Browning . | |
| 4,545,157 | | 10/1985 | Saurwein . | |
| 4,545,317 | | 10/1985 | Richter et al. . | |
| 4,707,952 | | 11/1987 | Krasnof . | |
| 4,815,241 | * | 3/1989 | Woodson | 451/75 |
| 4,817,342 | | 4/1989 | Martin et al. . | |
| 5,184,427 | | 2/1993 | Armstrong . | |
| 5,365,699 | | 11/1994 | Armstrong et al. . | |
| 5,390,450 | | 2/1995 | Goenka . | |
| 5,405,283 | | 4/1995 | Goenka . | |
| 5,514,024 | | 5/1996 | Goenka . | |
| 5,545,073 | | 8/1996 | Kneisel et al. . | |
| 5,601,478 | * | 2/1997 | Mesher | 451/75 |
| 5,616,067 | * | 4/1997 | Goenka | 451/39 |
| 5,681,206 | * | 10/1997 | Mesher | 451/39 |

FOREIGN PATENT DOCUMENTS

| | | |
|---|---|---|
| 41 20 613 | 3/1992 | (DE) . |
| 42 44 234 | 6/1994 | (DE) . |
| 0 383 556 | 8/1990 | (EP) . |
| 0 526 087 | 2/1993 | (EP) . |
| 0 691 183 | 1/1996 | (EP) . |
| 1 603 090 | 11/1981 | (GB) . |
| 58-144995 | 8/1983 | (JP) . |

* cited by examiner

*Primary Examiner*—David A. Scherbel
*Assistant Examiner*—Shantese McDonald
(74) *Attorney, Agent, or Firm*—Christensen O'Connor Johnson Kindness PLLC

(57) ABSTRACT

A method and apparatus for producing a high-velocity particle stream at low cost through multi-staged acceleration using different media in each stage, the particles are accelerated to a subsonic velocity (with respect to the velocity of sound in air) using one or more jets of gas at low cost, then further accelerated to a higher velocity using jets of water. Additionally, to enhance particle acceleration, a vortex motion is created, and the particles introduced into the fluid having vortex motion, thereby enhancing the delivery of particles to the target.

26 Claims, 4 Drawing Sheets

METHOD AND APPARATUS FOR PRODUCING A HIGH-VELOCITY PARTICLE STREAM

CROSS REFERENCE TO RELATED APPLICATION

This application is a continuation-in-part of application Ser. No. 08/891,667, filed Jul. 11, 1997 abandoned.

FIELD OF THE INVENTION

This invention relates to a processing and apparatus for producing a high-velocity particle stream suitable for use in a variety of settings including, but not limited to, surface preparation, cutting, and painting.

BACKGROUND OF THE INVENTION

The delivery of high-velocity particle streams for surface preparation, such as the removal of coatings, rust and miliscale from ship hulls, storage tanks, pipelines, etc., has traditionally been accomplished by entraining particles in a high-velocity gas stream (such as air) and projecting them through an acceleration nozzle onto the target to be abraded. Typically, such systems are compressed-air driven, and comprise: an air compressor, a reservoir for storing abrasives particles, a metering device to control the particle-mass flow, a hose to convey the air-particle stream, and a stream delivery converging-straight or converging-diverging nozzle.

The delivery of high-velocity particle streams for the cutting of materials, such as the "cold cutting" (as opposed to torch, plasma and laser cutting, which are "hot-cutting," thermal-based methods) of alloys, ceramic, glass and laminates, etc., has traditionally been accomplished by entraining particles in a high-velocity stream of liquid (such as water) and projecting them through a focusing nozzle onto the target to be cut. Typically, such systems are high-pressure water driven, and comprise: a high-pressure water pump, a reservoir for storing abrasives particles, a metering device to control the particle mass flow, a hose to convey the particles, a hose to convey high-pressure water, and a converging nozzle within which a high-velocity fluid jet is formed to entrain and accelerate the particle stream onto the target to be cut.

Whether the particle stream is delivered for the purpose of surface preparation or cutting, the mechanism of action, known to the skilled artisan as "micromachining," is essentially the same. Other effects occur, but are strictly second-order effects. The principle mechanics of micromachining are simple. An abrasive particle, having a momentum (I), which is the product of its mass (m) times its velocity (v), impinges upon a target surface. Upon impact, the resulting momentum change versus time (m x dv/dt) delivers a force (F). Such force applied to the small-impact footprint of a sharp particle gives rise to localized pressures, stresses and shear, well in excess of critical material properties, hence resulting in localized material failure and removal, i.e., the micromachining effect.

As evidenced by the above discussion, since the specific gravities of commercially significant abrasive particles are within a narrow range, any major increase in their abrading or cutting performance must come from an increase in velocity. Second, not only is velocity important, but, for surface preparation applications, the particles must contact the surface in a uniformly diffuse pattern, i.e., a highly focused stream would only treat a pinpoint area, hence requiring numerous man-hours and large quantities of abrasive to treat a given surface. Third, ideally, the particles should impinge upon the surface to be treated and not upon each other. Yet, for cutting applications, a focused stream is desirable in order to erode deeper and deeper into the target material and, in some applications, to sever it.

The skilled artisan in the particle stream surface preparation and abrasive cutting art, desiring to perfect an apparatus or method for surface preparation or cutting, faces a number of challenges. First, the amount of abrasive particles required per area of coating removed can be very high, which in turn means not only higher costs of use, but higher clean-up and disposal costs.

Second, the use of abrasive particles in the conventional dry blasting process described herein generates tremendous amounts of dust, both from the particles themselves and from the pulverized target material upon which the particles impinge. Such dust is highly undesirable because it is both a health hazard and an environmental hazard. It is also a safety and operations-limiting concern to nearby machinery and equipment. To ameliorate this, some systems add water at a low pressure to wet the particles immediately before ejection from the apparatus' nozzle assembly. Yet the water has the undesirable side effect of reducing the velocity of the abrasive particles, which, in turn, reduces the effectiveness of the particles for their intended purpose (i.e., coating removal or materials cutting). Adding water has the additional undesirable side effect of causing the abrasive particles to aggregate and form slugs which also severely diminishes their effectiveness. It is the shared belief in the industry that water cannot be added to a dry air/particle stream without diminishing the particle velocity. This belief has been corroborated by extensive testing. Yet the addition of water to the air/particle stream is essential for many applications to suppress dust generation, and, may in fact be the only remedy that complies with applicable environmental, health and occupational/operational safety regulations.

Third, currently available particle stream abrasive cutting systems (using abrasive particles to cut low-cost materials such as steel, concrete, wood, etc.) require a much higher power input relative to other current methods such as: torch, plasma, laser or diamond-blade cutting, for instance. Hence the inferiority of abrasive cutting relative to other methods is not due to cutting efficacy, but rather cost. Air or water jet-driven abrasive cutting requires a higher power input, making it cost-prohibitive for most applications other than for special situations which mandate cold-cutting and/or contour cutting of thermally sensitive materials.

Therefore, the problem facing the skilled artisan is to design an apparatus or method that delivers an evenly distributed, diffuse stream of abrasive particles to a surface to be cleaned (or a focused stream of abrasive particles to a surface to be cut) at the highest velocity, at the lowest possible power input, and without the generation of unacceptable levels of airborne dust.

The most straightforward solution, which is increasing the velocity of the particles, is problematic. This is done conventionally by entrainment of the particles in air, though air is an ineffective medium to accelerate particles over a short distance, due to its low relative density and practical-length limitations for an operator-deployable entrainment/acceleration nozzle. That is, the particles, beyond a certain velocity, do not continue to accelerate with the air, but move more slowly than the air, in a slip stream. Particle velocity, when driven by an air stream, is further reduced because often, water must be introduced into the air/particle stream to "wet" the particles to reduce airborne dust. This water, upon entrainment within the particle/air stream, results in a further reduction of the stream's velocity-often a substantial reduction.

Therefore, a crucial need in the art would be met by the development of a method or apparatus that delivers an evenly distributed, diffuse stream of abrasive particles to a surface (to be cleaned) or a focused stream to a surface (to be cut) at the highest possible particle velocity, at the lowest possible power input, and which does not generate unacceptable levels of airborne dust.

SUMMARY OF THE INVENTION

One object of the present invention is to provide a method for producing a stream of particles moving at a high velocity through a chamber by accelerating the particles using one or more jets of gas, and then accelerating the particles to a higher velocity using one or more jets of liquid.

A second object of the present invention is to provide a method for producing a stream of particles moving at high velocity through a chamber by accelerating the particles to a subsonic velocity using one or more jets of gas, and then accelerating the particles to a higher velocity using one or more jets of liquid and inducing radial motion to the particles.

A third object of the present invention is to provide a method for increasing the concentration of particles having a higher density than their surrounding fluid, in a high-velocity fluid stream, by introducing the particles into a fluid stream having radial flow, and then contacting the particles with a high-velocity fluid stream.

A fourth object of the present invention is to provide an apparatus for producing a fluid jet stream of abrasive particles in a fluid matrix.

In accordance with the first aspect of the present invention, there is provided a method for producing a stream of particles moving at high velocity in a chamber, comprising the steps of accelerating said particles to subsonic velocity using one or more jets of gas; thereafter, accelerating said particles to a higher velocity using one or more jets of liquid by contacting said stream at an oblique angle with one or more jets of ultra-high pressure water within the chamber.

In one preferred embodiment of the aforementioned aspect, the method comprises the additional step of inducing radial motion to said particles by the downstream injection of one or more jets of fluid.

In yet another preferred embodiment of the aforementioned aspect, the method comprises the additional step of inducing radial motion to said particles by narrowing the internal radius of the chamber.

In still another embodiment of the aforementioned aspect of the present invention, the method comprises the additional step of amplifying said radial motion to said particles by narrowing the internal radius of the chamber.

In still another embodiment of the aforementioned aspect of the present invention, the method comprises the additional step of amplifying said radial flow into said stream by using a variable-radius chamber.

In yet another preferred embodiment of the aforementioned aspect of the present invention, the method referred to above comprises the additional step of increasing the concentration of particles having a higher density than their surrounding fluid, in a high-velocity fluid stream further comprising the steps of introducing said particles into a fluid stream having radial flow, and contacting said particles with a high-velocity fluid stream.

In accordance with another aspect of the present invention, there is provided a method for producing a stream of particles moving at high velocity in a chamber, comprising the steps of accelerating particles to subsonic velocity using one or more jets of gas; thereafter, accelerating said particles to a higher velocity using one or more jets of liquid by contacting said stream at an oblique angle with one or more jets of ultra-high pressure water within the chamber; thereafter inducing radial motion to said particles by the downstream injection of one or more jets of fluid.

In one particularly preferred embodiment of the aforementioned aspect of the present invention, the method referred to above further comprises the additional step of amplifying said radial flow into said stream by narrowing the internal radius of the chamber.

In another preferred embodiment of the aforementioned aspect of the present invention, the method referred to above further comprises inducing spreading of said stream by downstream widening of the internal radius of the chamber.

In still another preferred embodiment of the aforementioned aspect of the present invention, the abrasive particle stream referred to above is accelerated to a velocity of greater than about 600 ft/sec.

In still another embodiment of the aforementioned aspect of the present invention, the abrasive particle stream is accelerated to a velocity of greater than about 1000 ft/sec.

In yet another embodiment of the aforementioned aspect of the present invention, the abrasive particle stream is accelerated to a velocity of greater than about 2000 ft/sec.

In yet another embodiment of the aforementioned aspect of the present invention, the abrasive particle stream is accelerated to a velocity of greater than about 3000 ft/sec.

In accordance with another aspect of the present invention, there is provided a method for increasing the concentration of particles having a higher density than their surrounding fluid, in a high-velocity fluid stream comprising the steps of introducing said particles into a fluid stream having radial flow; thereafter, contacting said particles with a high-velocity fluid stream.

In a particularly preferred embodiment of the aforementioned aspect of the present invention, the method referred to above comprises the additional step of passing said particles through a chamber of decreasing radius.

In a particularly preferred embodiment of the aforementioned aspect of the present invention, the method referred to above comprises the additional step of passing said particles through the chamber of decreasing radius, and thereafter passing said particles through a chamber of increasing radius.

In accordance with yet another aspect of the present invention, there is provided an apparatus for producing a fluid jet stream of abrasive particles in a fluid matrix, comprising a mixing chamber; an air/particle inlet means at one end of said mixing chamber for delivering an air/particle stream into the mixing chamber; one or more ultra-high pressure water inlet means fluidly and obliquely engaging said mixing chamber for accelerating said air/particle stream; and one or more air inlet means upstream, at or downstream from the water inlet means and fluidly engaged to the mixing chamber for inducing or amplifying radial flow to said stream.

In one preferred embodiment of the aforementioned aspect of the present invention, the mixing chamber referred to above comprises a converging portion and a diverging portion.

In another preferred embodiment of the aforementioned aspect of the present invention, the mixing chamber comprises a converging portion.

In still another embodiment of the aforementioned aspect of the present invention, the mixing chamber comprises a diverging portion.

In yet another embodiment of the aforementioned aspect of the present invention, the mixing chamber comprises a diverging portion and a focusing tube.

The current apparatus and method provides many advantages over currently available systems. Again, the central problem facing the skilled artisan is how to propel the particles to their highest possible practical velocity using the least power using an apparatus of practical dimensions. First, the present invention achieves this goal of maximizing particle velocity with relatively low input power and within an embodiment of practical size. The abrasive particles are accelerated in the present invention to a higher velocity than achieved with conventional systems, while requiring substantially less input power than conventional systems.

A second advantage of the present invention—directed to embodiments for surface preparation or coating removal—is that it achieves uniform particle spreading. This increases the amount of surface that can be treated per pound of abrasives, and results in higher productivity and lower costs per area treated, and in lower spent-abrasives clean-up and disposal costs. (Disposal costs can be substantial for spent-abrasives containing hazardous waste.)

These advantages are achieved by the present invention by several embodiments that induce and deploy a vortex, which imposes a controlled radial momentum, in addition to the forward axial momentum upon the particles. This results in a controlled spreading effect for the particles exiting from the mixing chamber, hence a wider surface area is exposed to the abrading particle stream, resulting in higher productivity and lower cost for surface preparation applications and correspondingly lower abrasives consumption per area treated.

A third advantage of the present invention pertains to underwater cutting and cleaning, or, in general, to situations where the high-velocity particle stream propelled from the chamber, must travel through a fluid other than a gas or air as it moves towards its intended target. It is well known to the skilled artisan that efficacy of high-velocity water jet and particle stream cleaning and cutting underwater decrease dramatically with stand-off distance, i.e., the distance between nozzle exit and target. The reason is the presence of a liquid media, such as water, which has a density about 800 times that of air in the region between the chamber exit and the target. Conventional high-velocity fluid jets, having to penetrate such media to reach their intended target, become entrained within the surrounding water. Hence, within a distance as short as 0.5 inches, the jets lose much of their energy and efficacy for their intended cleaning and cutting tasks. According to the present invention, air is discharged from the chamber in a swirling manner, forming a rotating, hence stabilized, zone of gas projecting from the chamber exit. A localized, air environment in the form of a stabilized, rotating, vortex-driven air pocket is generated between nozzle and target. Consequently, high-velocity particle and water jets can now pass through this stabilized air pocket, delivering unimpaired cutting or cleaning at "in-air" performance, yet obtained underwater.

A fourth, advantage of the present invention is that it eliminates the generation of dust and related environmental, health, occupational and operational safety hazards inherent to dry particle stream surface preparation (commonly referred to as sandblasting) in open air. Sandblasting is well known to generate dust clouds which can spread for miles containing particles small enough to constitute a significant breathable health hazard and cause eye irritation, not only to the operator, but to nearby persons. This dust contains not only pulverized abrasive particles, but may contain material particles removed from the treated surface. It may contain pigments and other surface-corrosion and anti-fouling compounds, such as heavy-metal oxides (e.g., lead oxide), organometals (particularly organotins) and other toxic compounds, perhaps applied to the surface years ago and long since outlawed. Dry sandblasting, while being fast and cost-effective, and with the exception of the present invention, without economical alternative, is being closely monitored and regulated by environmental protection and health-hazard control agencies.

Conventional systems attempt to ameliorate these problems by encapsulation, which means surrounding the blast site with large plastic sheets and creating a slightly negative pressure within the containment. This is extraordinarily expensive. For instance, typical sandblasting surface preparation may cost about $0.50/ft$^2$; this cost increases up to $2.00/ft$^2$ or more with encapsulation.

The present invention controls both dust formation and dust liberation. First, by using ultra-high velocity water jets to accelerate the abrasive particles in the second stage, all particles are thoroughly wetted and substantially no dust is generated at the nozzle exit and in the particles' trajectory to the surface to be treated. Secondly, the discharging particles are accompanied by a fine mist of water droplets, resulting from the break-up of the ultra-high velocity water jet as it interacts with the particles and air in the mixing chamber. Such mist scrubs—at the source—any fines and dust generated as a consequence of the particles impacting and disintegrating on the target or stemming from the micro-machined/removed target material.

A fifth advantage of the present invention is that the much lower rearward thrust is generated by the apparatus and method of the present invention. This is a result of the far lower particle mass flow rate per unit of surface cleaned (or cut) with fewer but much faster particles. Hence operating the apparatus causes less fatigue to the operator and should result in safer working conditions. Also, it makes the method and apparatus more amenable to incorporation into low cost automated systems.

The present invention will now be described in more detail in the following detailed description of preferred embodiments and drawings, together with the appended claims.

BRIEF DESCRIPTION OF THE DRAWINGS

The foregoing aspects and many of the attendant advantages of this invention will become more readily appreciated as the same becomes better understood by reference to the follow detailed description, when taken in conjunction with the accompanying drawings, wherein.

DETAILED DESCRIPTION OF THE PREFERRED EMBODIMENT

Figure 1:
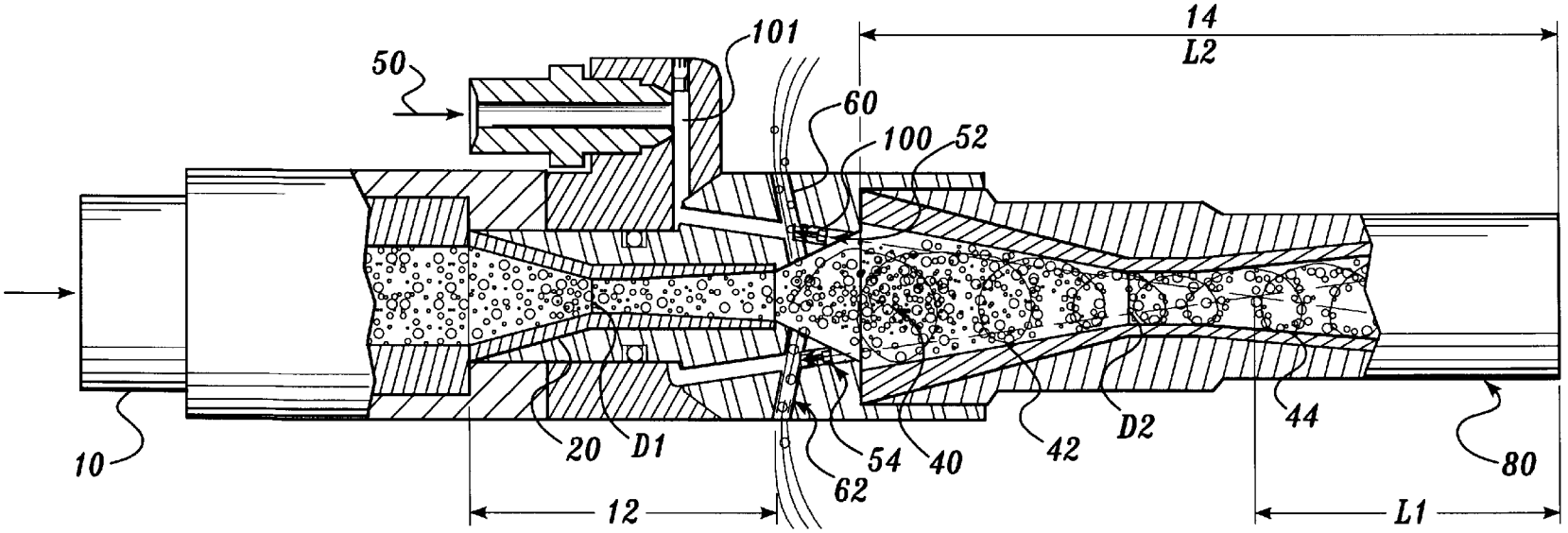
FIG. 1 is a cross-sectional view showing a nozzle representing a preferred embodiment of the present invention.

The present invention is directed to a method and apparatus for delivering abrasive particles via a high-velocity fluid stream for the purpose of treating or cutting a surface. First, abrasive particles (for instance, quartz sand) are propelled via entrainment in a pressurized gas (such as air) or by induction/aspiration through a hose leading into a nozzle having a hollow chamber or "mixing chamber." At this point, the velocity of the abrasive particles reaches about 600–640 ft/sec, which is close to some practical maximum velocity. More specifically, air is a poor medium to propel the abrasive particles due to its low density; that is, above a certain point, further increase to the velocity of the air will have only a negligible effect on the particle velocity. Yet air is a very cost effective means to accelerate the particle to about this velocity, but not much beyond.

After this acceleration of the particles to a subsonic velocity (with respect to the speed of sound in air), the air/particle stream next passes through the mixing chamber where it encounters one or more inlets, for the introduction of ultra-high velocity fluid jets (such as water jets) into the air/particle stream. The water jet or jets, having a relative velocity of up to 4,000 ft/sec with respect to the gas-jet pre-accelerated particles (moving at a velocity of up to about 600–640 ft/sec), further accelerates the particles through direct momentum transfer and entrainment to a higher velocity.

The ultra-high velocity water inlets are positioned such that the water impacts the air/particle stream at an oblique angle relative to the axis formed by the air/particle stream. Either by the convergence of the water jet with the air/particle stream, or by the internal geometry of the mixing chamber, or a combination of both, a vortex, or swirling motion of the air/particle/water stream is created within the mixing chamber. This vortex motion causes the abrasive particles to move radially outward, due to their larger mass (relative to the air and water), by centrifugal force creating an annular zone of high particle concentration. The ultra-high velocity water jets are directed at this zone to accomplish efficient momentum transfer to and entrainment of the particles, resulting in effective acceleration and a maximized particle velocity. Hence, the introduction of the ultra-high velocity water jets serves three principal functions: (1) a second-stage acceleration of the particles; (2) the creation of a vortex within the air/particle/water stream; and (3) the creation of a zone of high particle concentration for preferential and effective contacting of the particle stream with the ultra-high velocity water jets, resulting in more efficient acceleration and a higher particle velocity.

Also, in several preferred embodiments, the vortex motion created in the fluid stream is amplified in one of several ways. In one embodiment, the stream (now comprising air, particles, and water) passes through a final portion of the nozzle where it is subjected to tangentially introduced air. This air may be inducted into the nozzle chamber due to the negative pressure created in the chamber by the movement of the stream. Alternatively, the air may be injected into the chamber at a pressure greater than atmospheric pressure. In other embodiments, the internal diameter of the mixing chamber is narrowed, to increase the radial velocity of the particles, and thereby amplify the vortex motion. In a subset of these embodiments, the internal diameter of the mixing chamber is then subsequently widened to achieve uniform particle spreading. What exits the nozzle is a high-velocity stream of evenly distributed, abrasive particles traveling at a high velocity, propelled to such velocity in two acceleration stages, the first one being driven by a gas (compressed air) and the second one by a liquid (ultra-high pressure water). Not only can such two-stage acceleration, using two differing media (a gas and a liquid), overcome the basic limitations of accelerating particles beyond about 600 ft/sec using air as a driver, but the overall energy efficiency of the process is superior to single or multi-stage particle acceleration using a single media, such as either a gas only or a liquid only.

Thus, the surface removal rate (or cutting rate) is a function of two broad sets of parameters. The first set of parameters (aside from the abrasive particles themselves) relates to the initial air velocity that delivers the abrasive particles into the mixing chamber, the location and angle of the ultra-high velocity water jet or jets that converge with the air/particle stream, and similar parameters for the vortex-promoting air injection (if used in the particular embodiment). The second set of parameters relates to the geometry of the mixing chamber itself. For instance, a small diameter may be preferable at one location within the chamber to increase the rotational velocity of the abrasive particles, and hence increase particle interaction with the ultra-high velocity water jet or jets. The chamber may then widen downstream to produce controlled spreading of the particle stream. The particular geometry (internal radii) of the mixing chamber can be optimized experimentally for given air/water/particle flow rates and velocities.

"Oblique," as used herein, refers to an angle dimension, which is greater than 0 degrees but less than 90 degrees.

"Skewed," as used herein, refers to an angle dimension, which is greater than 0 degrees, but less than 90 degrees, measured in a different axis relative to an angle having an "oblique" dimension—e.g., if an angle formed by two objects lying along the x-axis has an "oblique" dimension, then an angle formed by two objects lying along an axis not parallel to that axis may be described as "skewed" (provided that it is between 0–90 degrees).

"Ultra-High Pressure," as used herein, refers to a particular type of pump capable of delivering water at pressures greater than about 15,000 psi, to about 60,000 psi.

"Ultra-High Velocity" refers to the velocity of a fluid jet (such as a water jet) having a velocity greater than 600 ft/sec up to about 4,000 ft/sec.

"Abrasive Particle," as used herein, refers generally to any type of particulate relied upon in the blasting industry for the purpose of ejecting from a device. Substances commonly used include quartz sand, coal slag, copper slag, and garnet. "BB2049"is the industry designation for one common type. The suffix 2049 refers to the particle size; the particles are retained by a 20–49 mesh, U.S. Standard Sieve series. Another common type is StarBlast.

FIG. 1 depicts one preferred embodiment of the present invention. The device shown is preferably constructed from commonly available materials known to the skilled artisan. The air/particle stream travels via an inlet hose 10 into a nozzle 20, where it encounters a mixing chamber 40. The device can be subdivided functionally into two stages, a first stage 12 and a second stage 14. In summary, in the first stage 12 the particles are accelerated by pressurized gas, preferably, but not exclusively, air. In the second stage 14, the particles are further accelerated by ultra-high pressure water. The approximate velocity of the particle stream as it exits nozzle 20 is about 600 ft/sec. As the air/particle stream moves through the mixing chamber 40, it encounters one or more ultra-high pressure water injection ports 52, 54, which introduce one or more ultra-high velocity water jets into the mixing chamber at an oblique angle relative to the central axis formed by the movement of the air/particle stream. The jets of water are formed by providing ultra-high pressure fluid through inlet 50 and annular passageway 101 to an orifice 100 positioned in each injection port 52, 54. The fluid jets converge with the air/particle stream, thereby accelerating the particles to a greater velocity. A second function of the ultra-high velocity water jets, by virtue of their oblique and/or skewed position, is to alter the direction of the stream, from purely axial to a vortex or swirling motion, thereby enhancing interaction of the particles within the fluid stream.

In one embodiment of the present invention, the stream, comprising air, particles, and water, exits the downstream end of the nozzle 80. In other particularly preferred embodiments, the fluid stream is further manipulated to enhance the vortex motion before exiting the nozzle. In one particularly preferred embodiment, the air/particle/water fluid stream travels downstream within the nozzle where it is further mixed with air.

The air may be introduced into the mixing chamber 40 by one of several means. In one preferred embodiment, the air enters the mixing chamber 40 by simple aspiration or passive induction through one or more holes 60, 62 placed in the nozzle and which allows ambient air to penetrate the mixing chamber. More specifically, in this preferred embodiment, the air is inducted into the mixing chamber through the holes 60, 62 due to the negative pressure created by the movement of the fluid stream through the mixing chamber.

In other embodiments, the air may be actively injected (under pressure) into the mixing chamber 40. Also, in the embodiment shown, the air enters the mixing chamber 40 through holes 60, 62 located upstream from the ultra-high water injection ports 52, 54, which introduce ultra-high pressure water into the chamber from an inlet 50. In other embodiments, the air may enter the chamber downstream from the water injection ports 52, 54. In still other embodiments, the air and water may enter the chamber simultaneously. Hence, the air enters the mixing chamber through passive movement, across a positive pressure gradient from outside to the mixing chamber and commingles with the air/particle/water fluid stream, further enhancing the vortex motion, hence facilitating particulate acceleration. In another particularly preferred embodiment, the air is not passively inducted into the mixing chamber, but is actively pumped into the mixing chamber under pressure, e.g., at pressures ranging from approx. 10 to 150 psi gauge.

Figure 2:
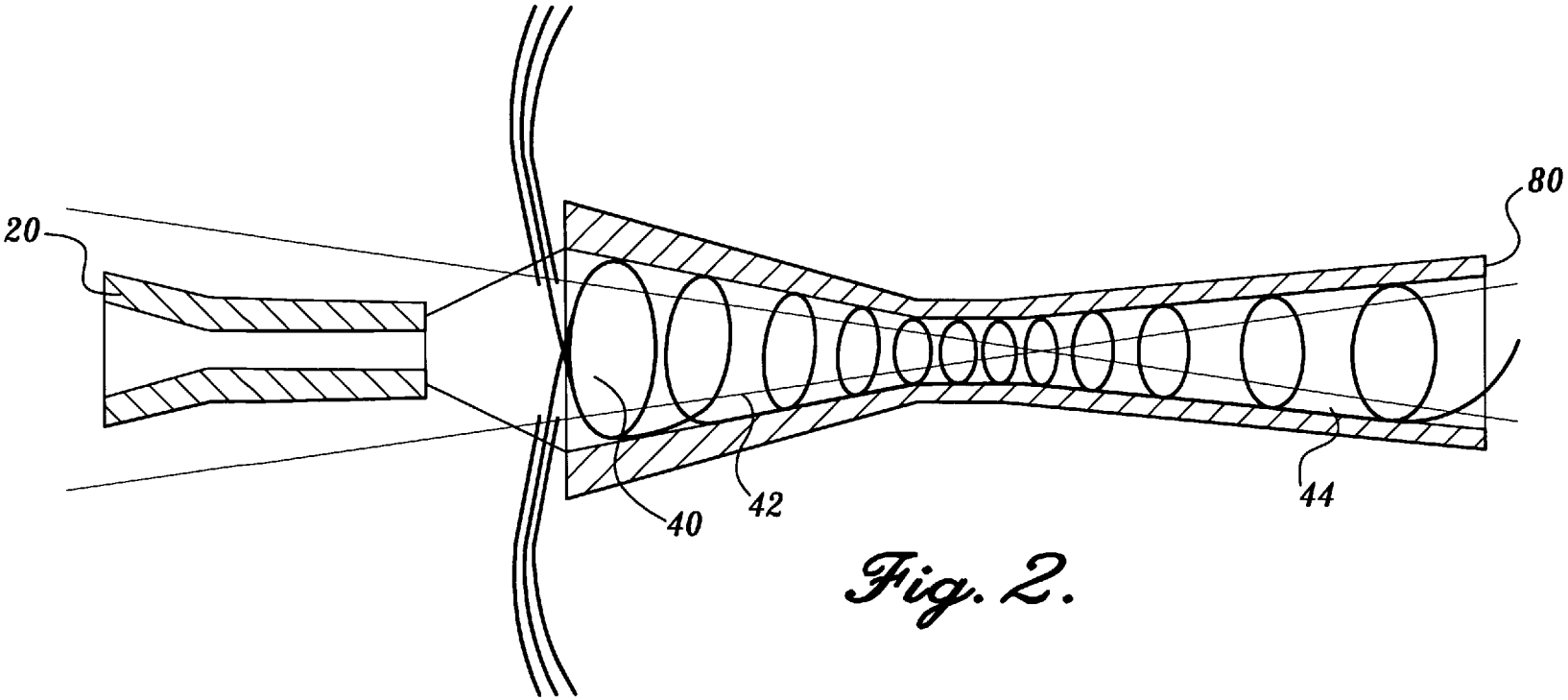
FIG. 2 is a crops-sectional diagram showing the internal features of the nozzle of FIG. 1, but stylized to emphasize the geometry of the nozzle chamber, and the path of the abrasive particles through the nozzle chamber.

In another preferred embodiment, the vortex motion is created (without the aid of air inflow into the mixing chamber 40) or further enhanced by altering the internal geometry of the mixing chamber. In some of these embodiments, as depicted in FIG. 2, the air/water/particulate stream moving through the mixing chamber 40 encounters a converging passage 42 (i.e., the mixing chamber diameter decreases). The consequence of this is that the radial velocity of the particles increases due to the principle of conservation of angular momentum. Increased radial velocity results in increased particle concentration in a zone upon which the ultra-high velocity water jets are directed, enhancing impingement and entrainment, hence the particle acceleration process within the chamber. Further downstream from this narrow portion of the chamber, the radius increases 44, which causes the abrasive particles to spread, i.e., due to movement towards the walls of the chamber resulting from the radial momentum imposed on the particles. Hence, the mixing chamber is comprised of a converging portion 42, followed by a diverging portion 44. Again, controlled and uniform spreading is desirable for surface preparation applications, because it increases the surface area impinged upon by the abrasive particles. In other embodiments, the vortex motion is created or enhanced by the placement of grooves or ridges or vanes on all or a portion of the interior wall of the mixing chamber.

In a preferred embodiment, the mixing chamber is further provided with one or more additional inlets that are in fluid communication with a source of chemicals. Although different chemicals may be used, depending on the context in which the device is used, in a preferred embodiment, corrosion inhibitors are introduced into the mixing chamber.

Figure 3:
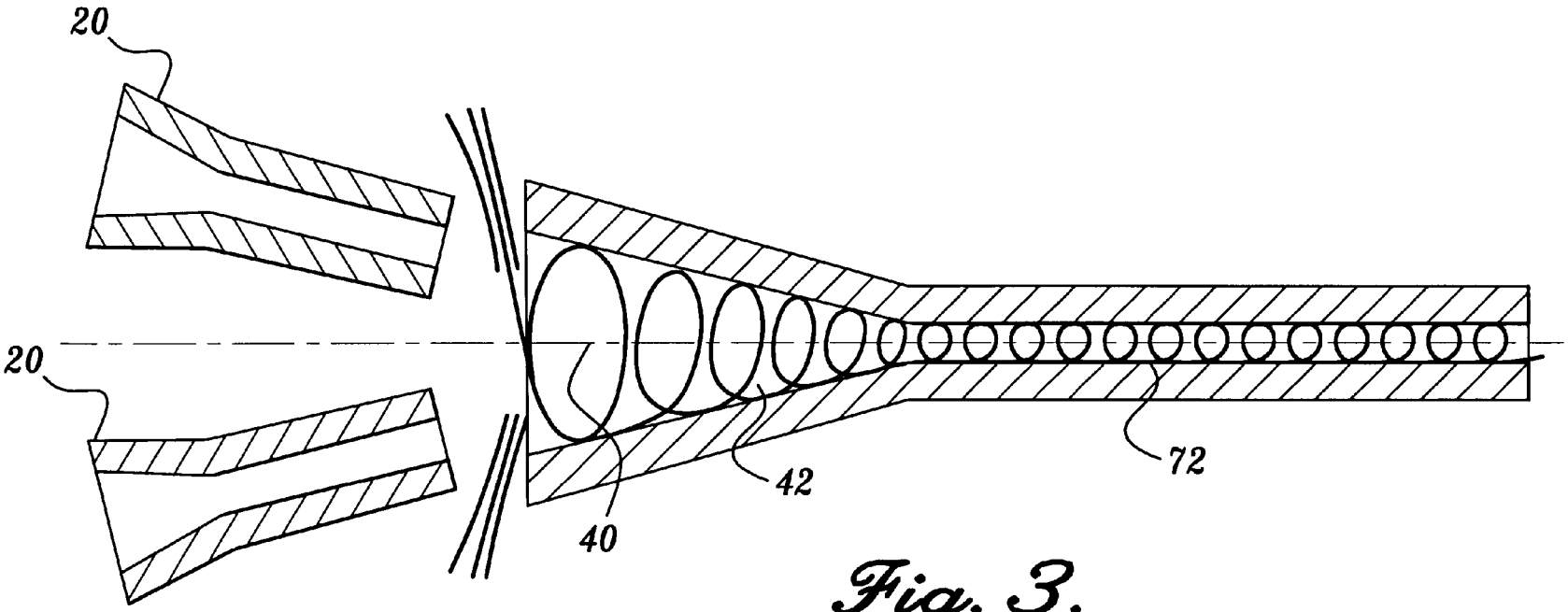
FIG. 3 is a cross-sectional diagram showing the internal features of another preferred embodiment the present invention, also stylized to emphasize the geometry of the nozzle chamber, and the path of the abrasive particles through the nozzle chamber.

FIG. 3 shows an additional preferred embodiment of the present invention. As in FIG. 2, the mixing chamber diameter decreases (converging portion 42) to increase radial velocity and concentrate the particles in a zone for effective interaction with the ultra-high velocity water jets, but does not subsequently diverge to produce spreading. Instead, the nozzle tapers to form a focusing tube 72. Hence, this embodiment is more suitable for cutting, in contrast to the embodiment shown in FIG. 2, which is more suitable for surface removal.

As further illustrated in FIG. 3, a single ultra-high pressure fluid jet is aligned with a longitudinal axis of the exit nozzle to enhance the cutting performance. The apparatus is also provided with multiple nozzles 20 offset from the longitudinal axis and the ultra-high pressure fluid jet to provide an even delivery of abrasives to the system.

The optimum removal or cutting rates may be obtained by optimizing the internal geometry of the mixing chamber, i.e., the internal radii, vortex enhancing geometries, the configuration of vortex enhancing air induction or injection ports, as well as the placement of the converging/diverging portions relative to the water and air inlets.

Figure 4:
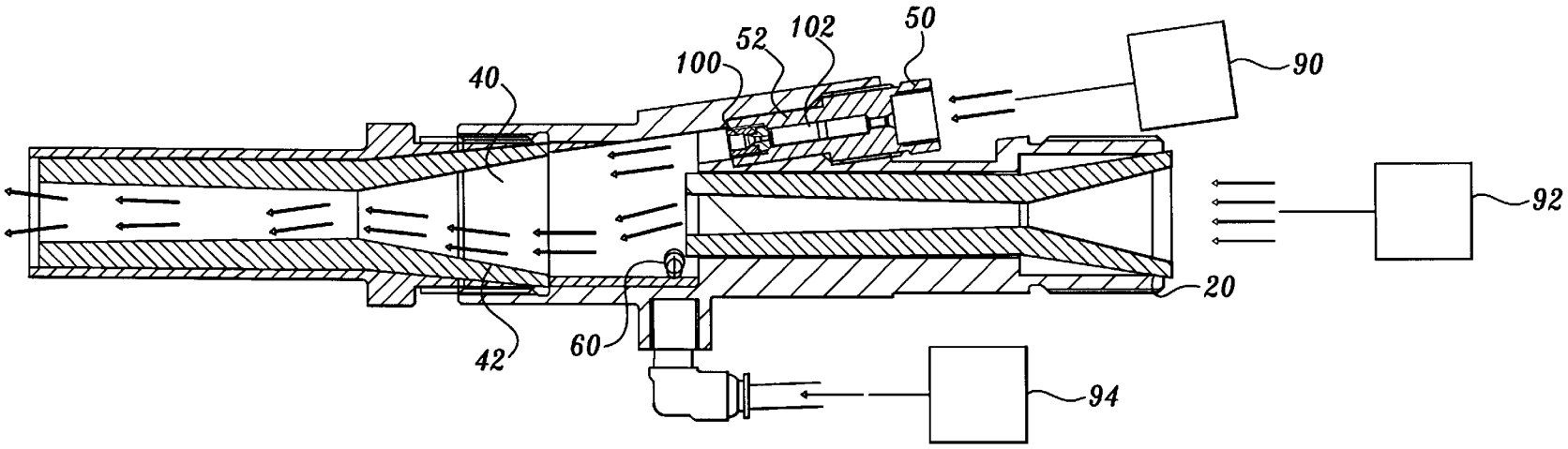
FIG. 4 is a cross-sectional view showing a nozzle provided in accordance with an alternative embodiment of the present invention.

In another preferred embodiment of the invention, as shown in FIG. 4, several modifications are made to reduce the weight of the device, to simplify the operation, and to reduce manufacturing costs. In the preferred embodiment illustrated in FIG. 4, the second stage acceleration of the abrasive particles is achieved by the introduction of a single ultra-high pressure fluid jet generated by directing ultra-high pressure fluid through inlet 50 and orifice 100 positioned in injection port 52. The inlet 50 and passageway 102 are directly aligned with the orifice 100 along a path on which the ultra-high pressure fluid jet leaves injection port 52 and enters mixing chamber 40. The single ultra-high pressure fluid jet enters the mixing chamber at an oblique angle, where it entrains and accelerates the abrasive stream. Similarly, only a single air inlet hole 60 is provided to allow air to be introduced tangentially into the mixing chamber 40. A device provided in accordance with the embodiment illustrated in FIG. 4 simplifies the use of the device and manufacturing, thereby reducing cost. To further reduce the weight of the device, the mixing chamber may be made of aluminum or silicon nitride, or other similar materials.

The apparatus provided in accordance with any of the preferred embodiments of the present invention may comprise a hand-held unit, commonly referred to as a gun. In a preferred embodiment, as schematically illustrated in FIG.

4, a series of valves 90, 92, 94 are provided on the nozzle, allowing the operator to selectively shut off the flow of water and/or abrasive. For example, the operator may wish to stop the flow of abrasive, such that only a stream of fluid and air exits the nozzle, allowing the operator to wash residue from an object being worked. Alternatively, the operator may wish to stop both the flow of water and abrasive, such that only a stream of air exits the nozzle, thereby allowing the operator to dry the object being worked. If the operator wishes to perform dry blasting, the flow of ultra-high pressure fluid through the nozzle may be stopped. The operator may therefore selectively change the function of the nozzle without releasing the nozzle, or having to go to a distant location near the source of abrasive or ultra-high pressure fluid. Although a variety of valves may be used, in a preferred embodiment, valves 90, 92, 94 are pilot valves that actuate valves at the source of ultra-high pressure liquid and source of abrasives.

A number of industrial-scale, comparative experiments were performed under properly controlled conditions to investigate both performance and economics of the method and apparatus subject to the present invention as compared with conventional devices and methods. The results of some of these experiments are disclosed below. The removal of zinc-based primer or mill-scale from a steel surface down to bare metal was chosen to evaluate the effectiveness of the present invention as compared with conventional methods. Although the context of this demonstration is surface preparation, it is intended not only to illustrate the superiority of the present invention for that application, but other applications as well, such as cutting, machining, milling, painting, in short, any application that relies upon the delivery of high velocity particles to a surface. By comparing the removal rates of a surface coating, under identical parameters, the superior performance of the apparatus and method of the present invention, relative to a conventional apparatus/method, can be demonstrated. Such experiments were designed to (a) confirm performance and economics of increased particle speed by means of two stage acceleration, and (b) confirm performance and economics of the vortex motion imposed upon the particles.

Parameters relevant to the following experiments are listed below. Also indicated is a range for each parameter within which the method and device can be further optimized. Refer to FIG. 1 for definitions, locations, dimensions and ratios.

The first parameter listed in Table 1 is the "Throat Diameter Ratio," which is the ratio of two diameters, $D_1$ and $D_2$. Each of these values are shown in FIG. 1; $D_1$ is measured at a point far upstream, near the air/particles inlet hose 10; $D_2$ is measured, further downstream, where the throat of stage 2 reaches its narrowest point. The second parameter shown is the "Length to Diameter Ratio," which is the ratio of $D_1$ and $L_2$, which are also depicted in FIG. 1. The next parameter shown is the "Joining Angle of $1^{st}$ Stage to $2^{nd}$ Stage." For the device depicted in FIG. 1, this angle is zero degrees, since the first stage 12 and the second stage 14 are coaxially aligned. The next parameter listed in Table 1 is "$1^{st}$ Stage Skew Angle discharging into $2^{nd}$ Stage. The device depicted in FIG. 1 has a skew angle of 0, though it cannot be shown in FIG. 1. This parameter is analogous to the previous one, except that the latter describes the spatial relationship between the two stages with respect to positioning of one stage relative to the other, in a plane perpendicular to the page on which the drawing appears. The "Power Ratio" is the ratio of the horsepower in stage 2 to the horsepower in stage 1, or the hydraulic horsepower to the air horsepower. This parameter is informative because, as evidenced by FIG. 1, the particles are accelerated by two sources: air via an inlet hose 10 in the first stage, and water via injection ports 52, 54 in stage 2. Each input requires a power source, hence the "Power Ratio" parameter. "Vortex Power Ratio" is similar to the parameter immediately above it, and is the horsepower applied to generate or enhance the vortex over the horsepower in stage 1 (air horsepower). The next parameter is the "Vortex Air Jet Ports," which refers to the number of inlets through which the vortex-inducing/enhancing air is introduced. Two inlets 60, 62 are shown in FIG. 1. The "Vortex Taper Included Angle" refers to the angle at which the inside diameter of the second stage 14 converges. More specifically, it refers to the angle formed by lines tracing a cross section of the interior wall of the second stage, measured from the beginning of the second stage 14 to $D_2$. The "Vortex Air Inlet Skew Angle" refers to the positioning of the air inlets 60, 62. The angle at which air enters the interior of the device relative to a plane parallel with the page on which the drawing is inscribed is the "Vortex Air Inlet Skew Angle." The next parameter is the "UHP Water Jets Trajectory Intersect," shown in FIG. 1 as $L_1$. As depicted by FIG. 1, $L_1$ is the distance from the point where the individual jets of ultra-high pressure water (delivered from the injection ports 52, 54) converge, to the end of the second stage (coterminus with $L_2$). A UHP Water Jets Trajectory Intersect value of "@$D_2$" means that the jets converge at the point $D_2$ (shown in FIG. 1). The parameter values are based on multiples of $D_2$; hence a value of $+10\times D_2$ means that the jets converge downstream from the point where $D_2$ is measured, by a distance of ten times the value of $D_2$. The next parameter refers to the number of ultra-high pressure water injection ports 52, 54. Two such ports are shown in FIG. 1. The next parameter listed in Table 1 is the "UHP Water Jet Injection Port Diameter," which is merely the inside diameter of the injection ports 52, 54. The next parameter is the "UHP Water Jet Included Angle" which is the angle formed by the two jets exiting the ports 52, 54. The final parameter in Table 1 is the "UHP Water Jet Skew Angle." This parameter partially defines the position of the individual ports 52, 54 along a plane perpendicular to the page upon which FIG. 1 appears.

TABLE 1

| Parameter | Parameter Range of Preferred Embodiments | Experimental Values |
|---|---|---|
| Throat Diameter Ratio ($D_2/D_1$) | 1–3.5 | 2.33 |
| Length to Diameter Ratio ($L_2/D_1$) | >5 | 23 |
| Joining Angle of $1^{st}$ Stage to $2^{nd}$ Stage | axial (0°)–30° | 0° & 15° |
| $1^{st}$ Stage Skew Angle discharging into $2^{nd}$ Stage | axial (0°)–30+ | 0° |

TABLE 1-continued

| Parameter | Parameter Range of Preferred Embodiments | Experimental Values |
|---|---|---|
| Power Ratio; Stage 2 UHP-Water/Stage 1 Air | 0.5–5.0 | 1.2–1.7 |
| Vortex Power Patio: Vortex Air/Stage 1 Air | 0.05 to 1.0 | 0.17 |
| Vortex Air Jet Ports (#) | 1–20 | 1–4; 6 |
| Vortex Taper Included Angle | −30 to +30° | 16° |
| Vortex Air Inlet Skew Angle | 0–30° | 0° |
| UHP Water Jets Trajectory Intersect | +/− 10 × $D_2$ | @ $D_2$ |
| UHP Water Jet Injection Ports (#) | 1–10 | 3, 4, 6 |
| UHP Water Jet Injection Port Diameter (inches/1000) | 8–40 | 7–13 |
| UHP Water Jet Included Angle | 0–30° | 16° |
| UHP Water Jet Skew Angle | 0–30° | 0°, 2°, 6° |

EXAMPLE 1

(Zinc Primer Removal) Comparison of one Embodiment of the Present Invention With a Conventional Surface Preparation Apparatus/Method The conventional device comprised a 3/16" diameter (or #3) converging/diverging dry abrasive blasting nozzle, which is common in the industry. The nozzle was driven by 100 psi air at a flow-rate of 50 $ft^3$/min to propel 260 lbs/hr of 16–40 mesh size abrasives onto the test surface.

The present invention apparatus comprised the conventional device described above, serving as its first acceleration stage, driven by the same air pressure, same air-flow rate and delivering the same abrasives mass-flow at identical particle size to the second acceleration stage. The second acceleration stage is water jet driven with a jet velocity of about 2200 ft/sec. Vortex action was not externally promoted, i.e., no additional fluid was injected from the side into the mixing chamber to amplify vortex action in the mixing chamber. Yet it should be noted that, though vortex motion was not deliberately induced, such motion may occur anyway as an inherent consequence of the internal geometry of the chamber.

The results are summarized below:

| Parameter | Present Invention | Conventional Device |
|---|---|---|
| Removal Rate | 180 $ft^2$/hr | 60 $ft^2$/hr |
| Abrasive particles used per unit area cleaned | 1.4 lbs/$ft^2$ | 4.3 lbs/$ft^2$ |
| Power Input (Horsepower) per unit area cleaned | 0.19 HP/$ft^2$ | 0.21 HP/$ft^2$ |
| Total Cost per unit area cleaned (includes labor, fuel, abrasives, and equipment charge) | \$0.18/$ft^2$ | \$0.38/$ft^2$ |
| Dust Generation at Nozzle | not detectable | pronounced |
| Dust Generation at Target (measured by visual inspection) | not detectable | pronounced |

EXAMPLE 2

(Zinc Primer Removal) Comparison of one Embodiment of the Present Invention With a Conventional Surface Preparation Apparatus/Method The conventional device comprised a 4/16" diameter (or #4) converging/diverging dry abrasive blasting nozzle, which is common in the industry. The nozzle was driven by 100 psi air at a flow-rate of 90 $ft^3$/min to propel 500 lbs/hr of 16–40 mesh size abrasives on to the test surface.

The present invention apparatus comprised the conventional device described above, serving as its first acceleration stage, driven by the same air pressure, same air-flow rate and delivering the same abrasives mass-flow at identical particle size to the second acceleration stage. The second acceleration stage is water jet driven with a jet velocity of about 2,200 ft/sec. Vortex action was not externally promoted, i.e., no additional fluid was injected from the side into the mixing chamber to amplify vortex action in the mixing chamber.

The results are summarized below:

| Parameter | Present Invention | Conventional Device |
|---|---|---|
| Removal Rate | 283 $ft^2$/hr | 75 $ft^2$/hr |
| Abrasive particles used per unit area cleaned | 1.8 lbs/$ft^2$ | 6.6 lbs/$ft^2$ |
| Power Input (Horsepower) per unit area cleaned | 0.18 HP/$ft^2$ | 0.30 HP/$ft^2$ |
| Cost per unit area cleaned | \$0.15/$ft^2$ | \$0.42/$ft^2$ |
| Dust Generation at Nozzle | not detectable | pronounced |
| Dust Generation at Target | not detectable | pronounced |

EXAMPLE 3

(Mill-Scale Removal) Comparison of one Embodiment of the Present Invention With a Conventional Surface Preparation Apparatus/Method The conventional device comprised a 4/16" diameter (or #4) converging/diverging dry abrasive blasting nozzle, which is common in the industry. The nozzle was driven by 100 psi air at a flow-rate of 90 $ft^3$/min to propel 500 lbs/hr of 16–40 mesh size abrasives onto the test surface.

The present invention apparatus comprised the conventional device described above, serving as its first acceleration stage, driven by the same air pressure, same air-flow rate and delivering the same abrasives mass-flow at identical particle size to the second acceleration stage. The second acceleration stage is water jet driven with a jet velocity of about 2,200 ft/sec. Vortex action was not externally promoted, i.e., no additional fluid was injected from the side into the mixing chamber to amplify vortex action in the mixing chamber.

The results are summarized below:

| Parameter | Present Invention | Conventional Device |
|---|---|---|
| Removal Rate | 165 $ft^2$/hr | 55 $ft^2$/hr |
| Abrasive particles used per unit area cleaned | 3.0 lbs/$ft^2$ | 9.1 lbs/$ft^2$ |
| Power Input (Horsepower) per unit area cleaned | 0.30 HP/$ft^2$ | 0.41 HP/$ft^2$ |
| Cost* per unit area cleaned | \$0.26/$ft^2$ | \$0.58/$ft^2$ |
| Dust Generation at Nozzle | not detectable | pronounced |
| Dust Generation at Target | not detectable | pronounced |

EXAMPLE 4

(Zinc Primer Removal) Comparison of one Embodiment of the Present Invention With a Conventional Surface Preparation Apparatus/Method The conventional device comprised a 3/16"diameter (or #3) converging/diverging dry abrasive blasting nozzle, which is common in the industry. The nozzle was driven by 100 psi air at a flow-rate of 50 $ft^3$/min to propel 260 lbs/hr of 16–40 mesh size abrasives onto the test surface.

The present invention apparatus comprised the conventional device described above, serving as its first acceleration stage, driven by the same air pressure, same air-flow rate and delivering the same abrasives mass-flow at identical particle size to the second acceleration stage. The second acceleration stage is water jet driven with a jet velocity of about 2,200 ft/see. Vortex action was promoted, through the injection of additional compressed air producing a rotation effect amounting to 0.17 inch-pound per pound of air entering the first acceleration stage.

The results are summarized below:

| Parameter | Present Invention | Conventional Device |
|---|---|---|
| Removal Rate | 210 $ft^2$/hr | 60 $ft^2$/hr |
| Abrasive particles used per unit area cleaned | 1.2 lbs/$ft^2$ | 4.3 lbs/$ft^2$ |
| Power Input (Horsepower) per unit area cleaned | 0.17 HP/$ft^2$ | 0.21 HP/$ft^2$ |
| Cost* per unit area cleaned | \$0.15/$ft^2$ | \$0.38/$ft^2$ |
| Dust Generation at Nozzle | not detectable | pronounced |
| Dust Generation at Target | not detectable | pronounced |

EXAMPLE 5

(MIR-Scale Removal) Comparison of one Embodiment of the Present Invention With a Conventional Surface Preparation Apparatus/Method The conventional device comprised a 4/16" diameter (or #4) converging/diverging dry abrasive blasting nozzle, which is common in the industry. The nozzle was driven by 100 psi air at a flow-rate of 90 $ft^3$/min to propel 500 lbs/hr of 16–40 mesh size abrasives onto the test surface.

The present invention apparatus comprised the conventional device described above, serving as its first acceleration stage, driven by the same air pressure, same air-flow rate and delivering the same abrasives mass-flow at identical particle size to the second acceleration stage. The second acceleration stage is water jet driven with a jet velocity of about 2,200 ft/sec. Vortex action was promoted, through the injection of additional compressed air producing a rotation effect amounting to 0.17 inch-pound per pound of air entering the first acceleration stage.

The results are summarized below:

| Parameter | Present Invention | Conventional Device |
|---|---|---|
| Removal Rate | 205 $ft^2$/hr | 55 $ft^2$/hr |
| Abrasive particles used per unit area cleaned | 2.4 lbs/$ft^2$ | 9.1 lbs/$ft^2$ |
| Power Input (Horsepower) per unit area cleaned | 0.26 HP/$ft^2$ | 0.41 HP/$ft^2$ |
| Cost* per unit area cleaned | \$0.21/$ft^2$ | \$0.58/$ft^2$ |
| Dust Generation at Nozzle | not detectable | pronounced |
| Dust Generation at Target | not detectable | pronounced |

EXAMPLE 6

(AM-Scale Removal) Comparison of one Embodiment of the Present Invention With a Conventional Surface Preparation Apparatus/Method The conventional device comprised a waterblast nozzle, delivering 25 hydraulic horsepower (HHP) driven by a pressure of 35,000 psi. Abrasives (size 40–60 mesh) in the amount of 500 lbs/hr were aspired by the water jet produced vacuum into the mixing chamber (rather than compressed air conveyed and pre-accelerated in a first stage nozzle, as in Examples 1–5). The present invention apparatus comprised the identical conventional device described above, plus vortex enhancing air injection amounting to an additional 7 HHP taking total system power to 32 HHP.

The results are summarized below:

| Parameter | Present Invention | Conventional Device |
|---|---|---|
| Removal Rate | 105 $ft^2$/hr | 90 $ft^2$/hr |
| Abrasive particles used per unit area cleaned | 3.3 lbs/$ft^2$ | 5.6 lbs/$ft^2$ |
| Power Input (Horsepower) per unit area cleaned | 0.23 HP/$ft^2$ | 0.31 HP/$ft^2$ |
| Cost* per unit area cleaned | \$0.27/$ft^2$ | \$0.43/$ft^2$ |
| Dust Generation at Nozzle | not detectable | pronounced |
| Dust Generation at Target | not detectable | pronounced |

EXAMPLE 7

The Superior Energy and Cost Effectiveness of Two-Stage Acceleration

Water and air can both be used to accelerate particles. The force acting on a particle being moved in a fluid is its drag ($F_D$). The equation for the drag force is:

$$F_D = C_D \times \rho v^2 A/2$$

where $F_D$ is the drag force, $C_D$ is the particle's drag coefficient, ρ is the density of the fluid, v is the relative velocity of the particle with respect to the surrounding fluid, and A is the particle's cross-sectional area or, in the event of an irregular shaped particle, its projected area.

$C_D$ is an experimentally determined function of the particle's Reynolds number ($N_R$). The Reynolds number is defined as:

$$N_R=\rho vd/\mu$$

where ρ is the fluid density; v is the relative particle velocity; d is the particle diameter; and $\mu$ is the fluid's dynamic viscosity. For $N_R$ from about 500 to 200,000 and for a spherical particle, representing a typical velocity span for accelerating particles with a higher velocity fluid stream, the drag coefficient $C_D$ is approximately in the range of 0.4 to 0.5, for air at subsonic speeds.

From the above analysis, it can be concluded that water, rather than air, would be an effective means to accelerate particles, due to the drag force being proportional to the moving fluid's density. The density ratio of water to air is about 800. However, utilizing water only as a driver fluid is prohibitively expensive. Delivery of air at a pressure of 100 psi at a rate of 1 cubic foot per minute can be accomplished with an industrial size compressor at a capital cost of only $60, and the resulting engine power amounts to a bare 0.25 HP for an airflow of 1 $ft^3$/min @100 psi pressure. Such air stream can accelerate particles to a velocity of about 600 ft/sec, but not much beyond, due to slip-stream effects prevailing at higher velocities. To accomplish the same task with water, a high-pressure water pump, capable of producing a pressure of about 5,400 psi at a delivery rate of 1 $ft^3$/min (7.5 GPM), would be required to accelerate the particles to a velocity of about 600 ft/sec (or to about 70% of the fluid velocity) with a capital cost of about $6,000, driven by about a 25 HP engine. The comparison of capital cost and required energy demonstrates that air can accelerate particles to a velocity of about 600 ft/sec at 1/100th of the capital cost and at about 1/100th of the energy input than what can be accomplished with water as a driving fluid. Hence air is a much more economical, energy efficient and preferred media for initial (first stage) particle acceleration, up to a velocity of about 600 ft/sec, whereas an ultra-high velocity water stream is the preferred media to accelerate the particles beyond 600 ft/sec (second stage) up to a velocity of about 3,000 ft/sec and beyond. A secondary consideration for utilizing air for first stage acceleration is that the particles are readily conveyed and transported in a turbulent air stream, within a hose or pipe, to extended distances and heights. Hence, the abrasive particle reservoir can be large, resulting in fewer interruptions to replenish the reservoir, and does not have to be near the nozzle ejecting the particles onto a surface to be abraded or cut.

EXAMPLE 8

Reducing Power Input Required for Cutting Materials Via Superior Particle Delivery Through Vortex Induction In one embodiment of the present invention, the benefit of accelerating particles with an ultra-high velocity water jet or jets is further exacerbated by inducing vortex, or swirling motion, into the fluid stream and subjecting the particles to such vortex or swirling motion. Trials conducted with such a configuration have produced superior results (measured by surface removal) which is evidence of superior momentum transfer onto and entrainment of the particles by the driving ultra-high velocity water jet. When the particles are contacted with a fluid having a vortex motion, the particles are propelled outward radially by centrifugal force. This force, and the resultant particle motion, is exploited in one embodiment of the present invention in the following way. As the particles are propelled outward by centrifugal force, they concentrate in a region where they are preferentially contacted with ultra-high velocity water jets, deliberately directed at such region. The result is a dramatically enhanced exit velocity of the particles being ejected from the chamber, a more energy efficient acceleration process, and the ability to introduce a greater concentration of particles relative into the driving, ultra-high velocity, water jet stream. Experiments conducted in support of the present application indicate that currently available technology is limited to introduction of about 12% of particles into the propelling fluid. By contrast, the present invention, through the introduction of vortex or swirling motion, allows for particle concentrations of up to 50% (relative to the driving water media) to be accelerated effectively to ultra-high velocities. This advance has been experimentally determined to derive from two sources. One, the number of particles contacted with the jets of water is enhanced by the vortex motion, which positions a maximum number of particles in the path of the water jet. Two, the centrifugal force exerted on the particles is very low with respect to the vector oriented approximately perpendicular to the water jets. If, for instance, the water jets contacted particles moving with a large resultant force substantially perpendicular to the direction of the water jets, then the acceleration of the particles in the direction of the water jets would be frustrated. The present invention overcomes that limitation-though still achieves maximum particle acceleration-by concentrating the particles into the water jet's path by centrifugal force, with a low resultant force in the direction perpendicular to the direction of the water jets.

The vortex motion can be induced by a variety of means well known to the skilled artisan. For instance, a variable radius chamber could be used, i.e., a chamber whose radius increases downstream. Also, grooves can be machined into the interior of the chamber or vanes can be added; alternatively, a fluid can be injected, inducted or aspired into the chamber at oblique angles or tangentially relative to the longitudinal axis formed by the chamber.

EXAMPLE 9

Achieving Superior Cutting Performance and Efficiency by Increasing Particle Velocity, Concentration and Focusing It has been shown within the context of this invention that incremental particle velocity (beyond a certain threshold) dramatically increases material removal for surface preparation and cutting applications. In fact, material removal increases with the square of a particle's velocity increase. Particle velocity under this invention can be increased by about 40–50% over what is achievable with current technology particle stream cutters, resulting in a two-fold increase in cutting performance. Two other factors also contribute materially to make an abrasive stream cutting process more efficient, namely (a) the quantity or concentration of maximum velocity particles ejected per unit of time $M_t$ (lbs/sec) and, (b) focusing such particle stream onto the smallest spot possible having a diameter $D_o$ (microns).

As applicants have shown in examples 4, 5 and 6 the imposition of vortex or swirl motion onto the particles dramatically enhances the acceleration process and ability to introduce more particles per unit of ultra-high velocity water (referred to as particle concentration) from about 12% for currently available technology to 50%, a four-fold increase. The vortex action also assists in focusing the particle jet to a smaller area $D_o$, hence the particle concentration per impacting area on a material is increased. With respect to a conventional technology particle stream apparatus, achieving a focusing diameter $D_c$, the particle concentration per area increases with the square of the diameter ratio $(D_c/D_o)^2$. According to the method and apparatus of the present invention, the focusing diameter can be reduced by about 25% of that of conventional abrasive particle stream cutters, resulting in a two-fold increase in cutting performance. The composite effect of the foregoing arguments is as follows:

| Variable | Cutting Performance Multiplier |
|---|---|
| Particle Velocity | 2x |
| Abrasive Concentration in Stream | 4x |
| Focusing | 2x |
| Composite Effect: 2x 4x 2 = | 16x |

Practically speaking, this performance multiplier has enormous consequences. More specifically, the current investment required for a conventional particle stream cutting system is about $2,000 per horsepower (HP) or about $60,000 for a typical 30 HP industrial system. A decrease by a factor 16 lowers the cost to about $4,000. It results in a method and apparatus now competitive with torch and plasma cutting for a wide variety of conventional, high volume applications, such as the cutting of steel plates, building materials, glass, wood, etc.

Therefore, the present invention is well-adapted to carry out the objects and attain the ends and advantages mentioned, as well as others inherent therein. While presently preferred embodiments of the invention have been, given for the purpose of disclosure of the salient features of this invention, numerous changes in the details of construction, arrangement of components, steps in the operation, and so forth, may be made which will readily suggest themselves to the skilled artisan and which are encompassed within the spirit of the invention and the scope of the claims.

The embodiments of the invention in which an exclusive property or privilege is claimed are defined as follows:

1. A method for producing a stream of particles moving at high velocity in a chamber, having an internal radius comprising the steps of:

(i) accelerating said particles to a subsonic velocity using at least one jet of gas; thereafter, (ii) accelerating said particles to a higher velocity using at least one jet of liquid by contacting said stream at an oblique angle with at least one jet of ultra-high pressure water within the chamber.

2. A method for producing a stream of particles moving at high velocity in a chamber, having an internal radius comprising the steps of:

(i) accelerating said particles to a subsonic velocity using at least one jet of gas; thereafter;

(ii) accelerating said particles to a higher velocity using at least one jet of liquid by contacting said stream at an oblique angle with at least one jet of ultra-high pressure water within the chamber; and (iii) inducing radial motion to said particles by the downstream injection of at least one jet of fluid.

3. The method of claim 2, comprising the additional step of:

amplifying said radial motion to said particles by narrowing the internal radius of the chamber.

4. The method of claim 1, comprising the additional step of:

inducing radial motion to said particles by narrowing the internal radius of the chamber.

5. The method of claim 1, comprising the additional step of:

increasing the concentration of particles having a higher density than their surrounding fluid, in a high-velocity fluid stream further comprising the steps of:

(i) introducing said particles into a fluid stream having swirling flow; thereafter, (ii) contacting said particles with a high-velocity fluid stream.

6. The method of claim 5, comprising the additional step of:

amplifying said swirling flow into said stream by using a variable-radius chamber.

7. A method for producing a stream of particles moving at high velocity in a chamber, comprising the steps of:

(i) accelerating particles to subsonic velocity using at least one jet of gas; thereafter, (ii) accelerating said particles to a higher velocity using at least one jet of liquid by contacting said stream at an oblique angle with at least one jet of ultra-high pressure water within the chamber; and (iii) inducing radial motion to said particles by the introduction of at least one jet of fluid.

8. The method of claim 7 wherein said radial motion is induced by the upstream injection of at least one jet of fluid.

9. The method of claim 7 wherein said radial motion is induced by the downstream injection of at least one jet of fluid.

10. The method of claim 7 wherein said introduction of at least one jet of fluid occurs by injection of pressurized fluid.

11. The method of claim 7 wherein said introduction of at least one jet of fluid occurs by passive aspiration of fluid.

12. The method of claim 7 wherein said fluid is air.

13. A method for producing a stream of particles moving at high velocity in a chamber, comprising the steps of:

(i) accelerating particles to subsonic velocity using at least one jet of gas; thereafter, (ii) accelerating said particles to a higher velocity using at least one jet of liquid by contacting said stream with at least one jet of ultra-high pressure water within the chamber; and (iii) inducing radial motion to said particles by the introduction of at least one jet of fluid.

14. A method for producing a stream of particles moving at high velocity in a chamber, comprising the steps of:

(i) accelerating particles to subsonic velocity using at least one jet of gas; thereafter, (ii) accelerating said particles to a higher velocity using at least one jet of liquid by contacting said stream at an oblique angle with at least one jet of ultra-high pressure water within the chamber; thereafter, (iii) inducing radial motion to said particles by manipulating the internal configuration of said chamber.

15. The method of claim 14 wherein said radial motion is induced by a plurality of vanes placed in an interior wall of said chamber.

16. The method of claim 14 wherein said radial motion is induced by a plurality of grooves placed in an interior wall of said chamber.

17. The method of claim 14 wherein said radial motion is induced by varying the internal geometry of said chamber.

18. The method of claim 14, comprising the additional step of:

amplifying said radial motion by narrowing the internal radius of the chamber.

19. The method of claim 14, comprising the additional step of:

inducing spreading of said stream by downstream widening of the internal radius of the chamber.

20. The method of claim 14 wherein said abrasive particle stream is accelerated to a velocity of greater than about 600 ft/sec.

21. A method for increasing the concentration of particles having a higher density than their surrounding fluid, in a high-velocity fluid stream, comprising the steps of:

(i) introducing said particles into a fluid stream having radial flow; and (ii) contacting said particles with an ultra-high pressure liquid stream.

22. The method of claim 21, comprising the additional step of passing said particles through a chamber of decreasing radius.

23. The method of claim 21, comprising the additional step of passing said particles through a chamber of decreasing radius, and thereafter passing said particles through a chamber of increasing radius.

24. A method for generating an ultra-high pressure fluid-abrasive stream, comprising:

providing a pressurized stream of abrasive particles and air to a nozzle inlet;

accelerating the pressurized stream of abrasive particles to a first velocity, the pressurized stream of abrasive particles entering a mixing chamber;

introducing an ultra-high pressure liquid jet into the mixing chamber, the ultra-high pressure liquid jet contacting and accelerating the pressurized stream of abrasive particles to a second velocity that is higher than the first velocity to generate an ultra-high pressure fluid-abrasive stream; and discharging the ultra-high pressure fluid-abrasive stream through an exit orifice.

25. The method of claim 24 further comprising:

selectively allowing and preventing the flow of abrasive particles through the nozzle inlet.

26. The method of claim 24 further comprising:

selectively allowing and preventing the flow of the ultra-high pressure liquid jet upstream of the mixing chamber.

* * * * *